United States Patent [19]

Roberts

[11] Patent Number: 5,020,184

[45] **Date of Patent: * Jun. 4, 1991**

[54] DISPOSABLE RECEPTACLE FOR COLLECTING AND TRANSPORTING LOOSE DEBRIS

[76] Inventor: John W. Roberts, 9908 E. Bexhill Dr., Kensington, Md. 20895

[ * ] Notice: The portion of the term of this patent subsequent to Aug. 8, 2006 has been disclaimed.

[21] Appl. No.: 390,161

[22] Filed: Aug. 7, 1989

Related U.S. Application Data

[63] Continuation-in-part of Ser. No. 204,112, Jun. 8, 1988, Pat. No. 4,854,003.

[51] Int. Cl.[5] ..... B65D 33/08; B65D 33/28

[52] U.S. Cl. ..... 15/257.5; 383/7; 383/10; 383/76

[58] Field of Search ..... 383/7, 10, 24, 76; 15/257.1, 257.5, 257.6, 257.9; 294/1.1, 55

[56] References Cited

U.S. PATENT DOCUMENTS

| | | | |
|---|---|---|---|
| 422,240 | 2/1890 | Marshall . | |
| 1,308,263 | 7/1919 | Smith . | |
| 2,438,860 | 3/1948 | Miller . | |
| 2,732,872 | 1/1956 | Hurdle et al. . | |
| 3,106,303 | 10/1963 | Finocchiaro . | |
| 3,217,971 | 11/1965 | Shvetz | 383/77 |
| 3,312,263 | 4/1967 | Wahlstrom . | |
| 3,312,384 | 4/1967 | Heynemann | 383/13 |
| 3,747,653 | 7/1973 | Ringer . | |
| 3,762,454 | 10/1973 | Wilkins | 383/1 |
| 4,159,139 | 6/1979 | Gawedzinski . | |
| 4,471,600 | 9/1984 | Dunleavy | 294/1.1 |
| 4,519,183 | 5/1985 | Parody | 294/1.1 |
| 4,664,348 | 5/1987 | Corsaut, III et al. . | |
| 4,854,003 | 8/1989 | Roberts | 383/16 |

*Primary Examiner*—Stephen P. Garbe

*Attorney, Agent, or Firm*—Neuman, Williams, Anderson & Olson

[57] ABSTRACT

A bag for collecting and transporting loose debris such as leaves, twigs, grass cuttings and the like in which the bag mouth is held open and positioned to receive the debris by a person, with the top of the bag mouth hung behind the person by a shoulder harness attached thereto and the bottom of the bag mouth being moved along the ground by the person's feet, engaged in stirrups which are secured to the bottom of the bags. The bag is fabricated of an inexpensive plastic material which is conveniently disposed when filled with debris.

11 Claims, 2 Drawing Sheets

FIG. 1
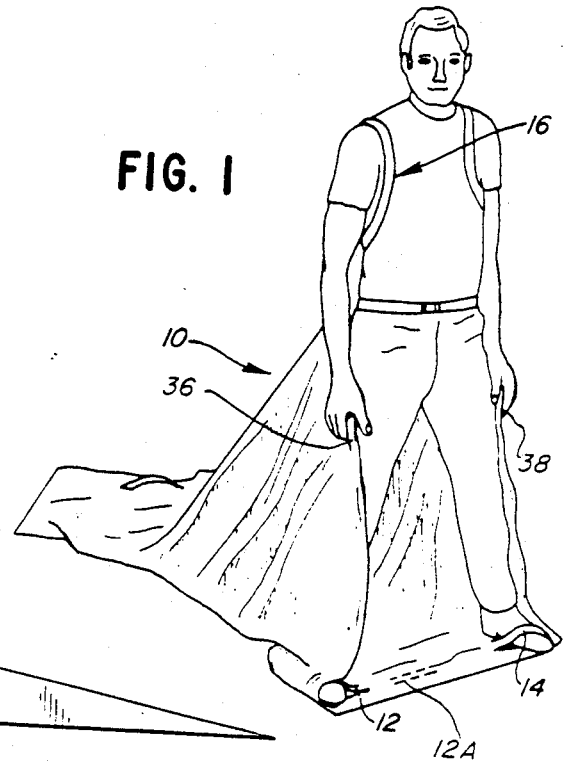
FIG. 2
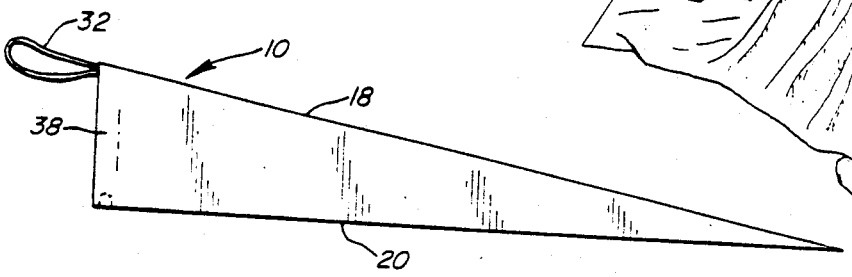
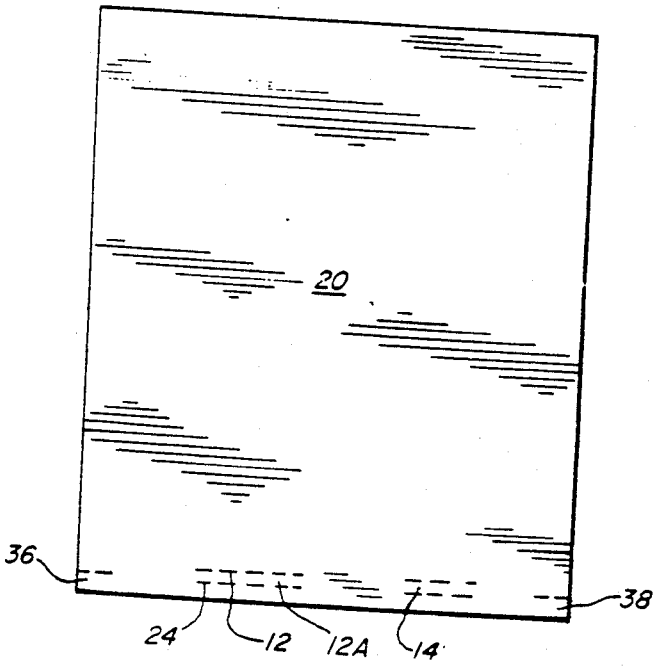
FIG. 3

FIG. 4
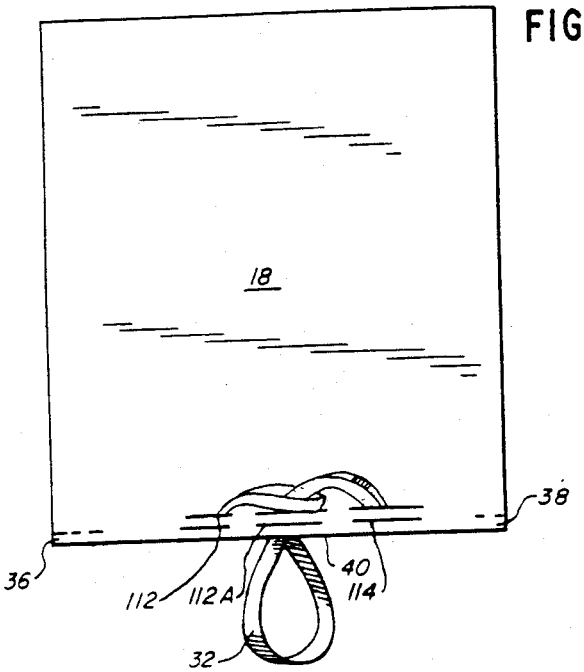
FIG. 5
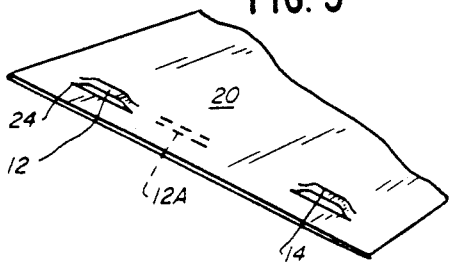
FIG. 6
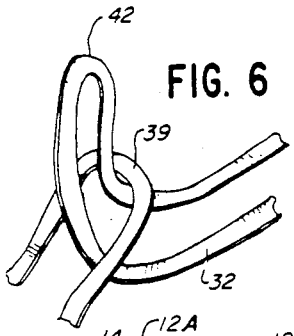
FIG. 7
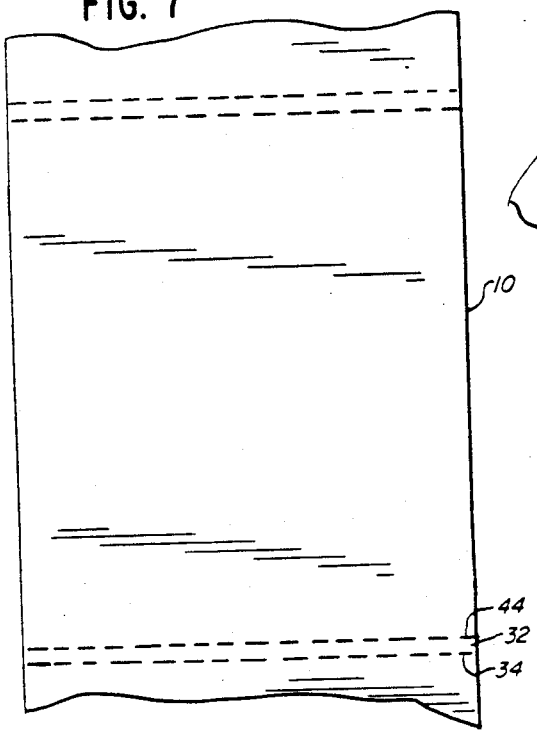
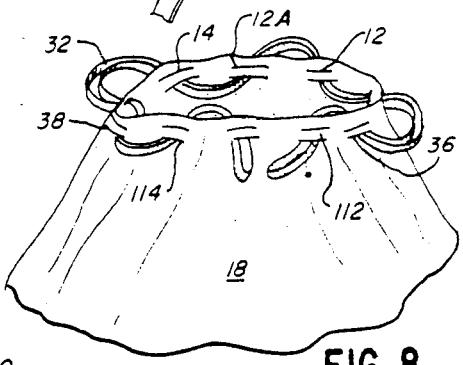
FIG. 8
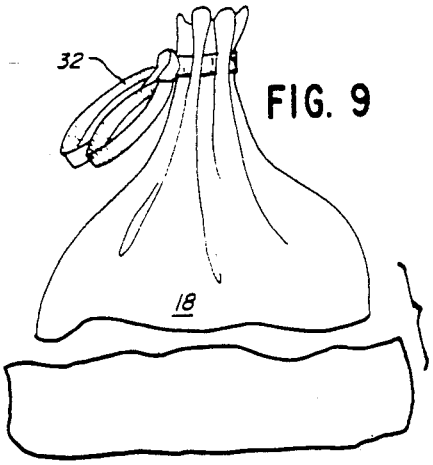
FIG. 9

DISPOSABLE RECEPTACLE FOR COLLECTING AND TRANSPORTING LOOSE DEBRIS

This is a continuation-in-part of application Ser. No. 204,112, filed June 8, 1988, U.S. Pat. No. 4,854,003.

BACKGROUND OF THE INVENTION

Field of the Invention

This invention relates to a receptacle for use in collecting and disposing of debris such as leaves, twigs, grass cuttings and the like. More particularly, it relates to a disposable bag which is held open and positioned to receive debris by a person, with the top of the bag mouth hung behind the person's shoulders and the bottom moved along the ground by the person's feet, engaged in stirrups secured to the bottom of the bag.

The widespread enactment of laws which prohibit the burning of leaves and other trash has created practical difficulties in the collection and disposal of loose debris. Although conventional plastic trash bags are frequently used for these tasks, they are not entirely satisfactory. The flexible nature of these bags has posed problems with handling and transport despite the use of an assortment of support structures for such bags. Examples of known prior art support devices for such trash bags are disclosed by and in Corsaut U.S. Pat. No. 4,664,348 and Gawedzinski U.S. Pat. No. 4,159,139. Even with such support structures, however, the use of plastic trash bags with known support devices involves considerable wasted effort owing to bending, stooping, lifting or carrying.

Others have proposed receptacles for collection or transport of debris which do not have all of the problems and inconveniences associated with plastic trash bags. See, for example, Ringer U.S. Pat. No. 3,747,653. Such devices, however, are frequently complex in their fabrication and awkward in their use, requiring that one hand be used to position and hold the device while lawn or other debris is being raked into the receptacle.

The present invention provides a novel bag for the collection and transport of debris which holds the mouth end of the bag in an open condition advantageous for filling and permits the free use of both hands for the raking operation. Since no ground support means are employed to prop the bag open, it can be used to collect debris in a variety of locations and it is not necessary to rake or sweep the debris into piles before collection. When the collection operation is completed, the bag is easily disposed in the manner of a conventional trash bag.

SUMMARY OF THE PRESENT INVENTION

It is an object of the present invention to provide an improved receptacle for the collection and transporting of debris. More specifically, it is an object to provide a lawn bag having a shoulder strap and stirrups which permit hands-free use, thus facilitating the raking and collection operation.

It is another object to provide a bag for the collection of lawn debris which is constructed of an inexpensive material that may be conveniently filled and easily disposed.

It is still another object of the present invention to provide a bag which is of such a size as to accommodate large quantities of debris, yet is also of relatively low weight and easy to carry.

It is still another object to provide an article which can be made using mass production techniques and which is susceptible to being packaged and retailed in a compact form at a reasonable price.

Generally, the objects of the present invention are accomplished in a bag when the mouth end is propped open by a person by way of a shoulder harness extending from the upper lip of the bag's mouth end and a pair of stirrups formed in the lower lip of the bag's mouth end. A person raking leaves or other lawn debris dons the shoulder harness and places his feet in the stirrups such that the bag extends behind him and is oriented and located by the person's forward walking movement. The user may then conveniently use both hands to rake debris toward himself, through the space between his legs and into the bag. Since the bag moves with the user, there is no need to rake the debris into multiple piles for collection. Moreover, the user carries the bag behind him automatically and doesn't have to bend and stoop over to hold the bag open or to lift it or to relocate it. The debris collection bag of the present invention is constructed in a durable manner and fabricated of a plastic material which may be conveniently filled. When the filling operation is completed, the shoulder harness may be woven through the stirrups to provide a draw string to close the mouth end of the bag which may then be easily disposed.

While the invention disclosed herein has been described primarily with reference to a bagger of lawn debris, it is to be understood that it is within the scope of the invention to provide a bag for collecting other types of debris from a variety of surfaces which incorporates the same novel features.

BRIEF DESCRIPTION OF THE DRAWINGS

For a more complete understanding of this invention, reference should be made to the drawings, as briefly described below:

FIG. 1 is a perspective view of the present invention showing how it is held open by a person using the shoulder harness and stirrups.

FIG. 2 is a schematic cut-away side view of a bag fabricated according to the present invention, showing the shoulder harness, carrying handles and stirrups.

FIG. 3 is a plan view of the inside face of the bottom panel of a bag fabricated according to the present invention, showing a pair of spaced stirrups and an optionally spaced stirrup, with one carrying handle located on each side, midway down the bag mouth, formed in the forward edge.

FIG. 4 is a plan view of the inside face of the top panel of a bag fabricated according to the present invention, showing a shoulder strap affixed to the forward edge, with one handle located on each side, midway down the bag mouth, formed in the proximity of the forward edge.

FIG. 5 is an enlarged detail view of the stirrups as employed in the bag of the present invention.

FIG. 6 is a detailed perspective view of the shoulder strap employed in the bag of the present invention.

FIG. 7 is a fragmentary plan view of a plurality of bags formed in a continuous web in accordance with the present invention.

FIG. 8 schematically illustrates a shoulder strap being woven through the strips and slots of a bag for closing the same, and FIG. 9 schematically illustrates such a bag with the mouth closed.

DESCRIPTION OF THE PREFERRED EMBODIMENT

Referring now to FIG. 1, a person is shown along with the bag 10 for collecting and transporting lawn debris of the present invention. Further shown are the stirrups 12 and 14 as well as an optionally spaced stirrup 12A formed at the bottom inside lip of the bag and the shoulder harness 16 which extends from the top of the bag.

In keeping with the aforestated objectives, the bag 10 is fabricated as illustrated in FIGS. 2–7. In the preferred embodiment, bag 10 is fabricated of biodegradable plastic to promote quick decomposition of bag 10, although plastic of the type commonly used in lawn and garbage bags will work just as well. Two panels form bag 10 and include a top panel 18 and a bottom panel 20. Panels 18 and 20 may be joined together using a heat sealing process considered to be known within the skill of the art along three sides to form the bag 10 with one open or "mouth" end, as shown in FIG. 2. In the preferred embodiment of the present invention, bag 10 measures approximately 88 inches long by 78 inches wide.

As shown in FIG. 3 and more particularly in FIG. 5, bag 10 provides locations for stirrups 12, 12A and 14. Preferably, each stirrup comprises a plastic strip defined by perforations in the bottom panel 20 of bag 10, one of which is shown as perforation 24. Stirrups 12, 12A, and 14 are formed when the plastic strips are separated from the bottom panel 20. Stirrups 12, 12A and 14 are preferably five inches long and two inches wide, spaced one inch from the forward edge of both the top and bottom panels. Advantageously, perforations defining plastic strips which may be used as locations for stirrups 12, 12A and 14 are formed in both top panel 18 and bottom panel 20 so that the user may initially place his feet in either the top panel 18 or the bottom panel 20.

It will be appreciated that the exact placement of the stirrups can vary within the teachings of the present invention. It has, nevertheless, been determined that the stirrups 12 and 14 are conveniently situated approximately 31 inches apart in the preferred embodiment. An optional stirrup 12A may also be placed 24 inches from stirrup 14 to easily accommodate users of varying heights. Handles 36 and 38 are used to assist in moving the bag during the raking operation, and are formed on each side of joining panels 18 and 20. Handles 36 and 38 are defined by a separable perforation preferably six inches long and located three inches from the mouth end of bag 10.

Opposite stirrups 12, 12A and 14 on the mouth end of bag 10 are identical plastic strips 112, 112A and 114 defined by perforations in bag 10. The perforations defining plastic strips 112, 112A and 114 may be separated to provide slots that secure a shoulder strap 32 which forms the shoulder harness 16, shown in FIG. 1. Once again, it will be appreciated that there are a number of designs for a shoulder harness which is suitable for the purposes of the present invention. In the preferred embodiment, one shoulder strap 32, a loop of 1½ inch plastic material, is used as the shoulder harness of top panel 18, as shown in FIGS. 5 and 6.

Shoulder strap 32 may be inserted in any combination of two of the three slots 112, 112A, and 114 depending on the size and shape of the user. By way of example, the first end 39 of the loop comprising shoulder strap 32 may be placed through slots 112 and 114 with the second end 42 of shoulder strap 32 interwoven through the first end 39 of shoulder strap 32 to form a securing knot 40, as seen in FIGS. 4 and 6. The second end 42 of strap 32 is thereafter pulled sufficiently for shoulder strap 32 to be fitted over the shoulders. Securing knot 40 is preferably located on the inward side of top panel 18.

As shown in FIG. 7, a plurality of bags such as bag 10 may be mass produced in a continuous web separated by perforations such as perforation 34. An intermediate perforation 44 separates shoulder strap 32 from bag 10. Perforation 34 which separates the bags is more defined than intermediate perforation 44. Shoulder strap 32 may thereby remain attached to bag 10 until use of bag 10.

The collection bag 10 is easily used. When empty, the bag 10 is readily collapsed and folded or rolled. When it is time to use the bag, the user positions himself at the mouth end of the bag and faces away from the rear end of the bag, such that the bag extends behind the user. The user then steps back into the mouth of the bag, places on the shoulder harness 16, and then places his feet through the stirrups 12 and 14. Of course, the user may initially place his feet in either of the two locations of the plastic strips forming stirrups to designate the bottom of the bag. At this point, the bag is propped in an open condition ready for filling. The user then can walk forward to the point of collection and use both hands to readily rake or sweep the lawn or other debris toward himself, in between his legs and into the bag 10.

At the conclusion of the loading operation, the user simply releases his feet from the stirrups 12 and 14, and holds bag 10 with the mouth end facing upward. After completion of the loading operation, shoulder harness 16 is woven through the plastic strips 112, 112A and 114, the slots defining and 38 and stirrups 12, 12A and 14. The mouth end of bag 10 may thereby be drawn in a closed position and the shoulder harness 16 may be tied to provide an easy carrying handle for disposal. The handles 36, 38 can also be used to facilitate the carrying and disposal of the bag 10.

From the description thus far provided, it is apparent that the proposed bag for the collection, transporting and disposal of lawn debris may be used in a number of applications and that a number of modifications can be made in the invention disclosed, by those having the benefit of the foregoing teachings, without departing from the spirit of these principles. Accordingly, while the invention disclosed herein has been described with reference to illustrations of the presently contemplated best mode for practicing the invention, it is intended that this invention be limited only by the scope of the appended claims.

What is claimed is:

1. A disposable receptacle for collecting and transporting, and disposing of loose debris comprising:

(a) a closed end;

(b) a mouth end opposite said closed end having an upper and a lower portion;

(c) a harness and means for attachment of said harness to said upper portion for securing said upper portion to the upper body of a person raking lawn debris; and (d) stirrups formed in said lower portion adapted to receive such person's feet;

such person thereby acting as a prop, when wearing said harness and stirrups, to support said disposable receptacle mouth end in an open position and to position said lower portion in sufficient proximity to the ground whereby loose debris can be readily introduced into the disposable receptacle, said disposable receptacle mouth end being located and oriented by such person's forward movement, said mouth end having a closed position when said bag is filled with loose debris for disposal of said bag.

2. The disposable receptacle of claim 1 wherein said harness is a shoulder harness.

3. A bag for collecting, transporting and disposing loose debris comprising:

(a) a rectangular bottom panel having a spaced pair of stirrups attached to its forward edge; and (b) a rectangular top panel having harness means attached to its forward edge;

said bottom and top panels secured together at their rearward edges and along their sides to form a bag having a mouth end with said harness means and stirrups adapted to be fitted to a person raking loose debris, such person acting as a prop, when wearing said harness means and stirrups, to support said bag mouth end in an open position and to position the forward edge of said bottom panel in sufficient proximity to the ground whereby loose debris can be readily introduced into the bag between such person's legs, said bag mouth end being located and oriented by such person's forward movement, said bag mouth end having a closed position when said bag is filled with loose debris for disposal of said bag.

4. The bag for collecting, transporting and disposing lawn debris of claim 3 wherein a handle is formed in the forward edge of said bag mouth end to facilitate transport, handling and disposing of the bag.

5. The bag for collecting, transporting, and disposing lawn debris of claim 3 wherein said harness means comprises a shoulder strap extending through slots formed in the bag.

6. The bag for collecting, transporting, and disposing lawn debris of claim 3 wherein said bottom and top panels are fabricated of a plastic material which promotes quick disposal when filled.

7. The bag for collecting, transporting, and disposing lawn debris of claim 3 wherein said bottom and top panels are fabricated of a biodegradable plastic material which promotes quick decomposition when filled and disposed.

8. The bag for collecting, transporting, and disposing lawn debris of claim 5 wherein each of said stirrups is comprised of portions of said bag defined by separable perforations located in proximity to the forward edge of said rectangular bottom panel.

9. A bag for collecting, transporting, and disposing loose debris comprising:

(a) a flat rectangular bottom panel;

(b) a flat rectangular top panel;

(c) a pair of stirrups defined by separable perforations located in the proximity of the forward edge of said bottom panel, adapted to receive a person's feet;

(d) a pair of slots defined by separable perforations located in the proximity of the forward edge of said top panel; and (e) a shoulder strap received within said pair of slots adapted to be worn by a person;

said bottom and top panels secured together at their rearward edges and along their sides to form a bag having a mouth end with a shoulder strap and stirrups adapted to be worn by a person raking loose debris, such person acting as a prop, when wearing said shoulder strap and stirrups, to support said bag mouth end in an open position and to position the forward edge of said bottom panel in sufficient proximity to the ground whereby loose debris can be readily introduced into the bag by raking same between such person's legs, said bag mouth end being located and oriented by such person's forward movement, said shoulder strap adapted to be woven through said slots and said stirrups to urge the mouth end of said bag to a closed position upon collection of loose debris.

10. A method of collecting loose debris comprising:

(a) providing a bag with a closed end and a mouth end having an open position and a closed position;

(b) securing spaced portions of the open mouth end of said bag to the upper body and to the feet of a user such that the user stands in the open mouth end of said bag facing opposite said closed end with his legs spaced apart to permit access therebetween of loose debris when said bag is in the open position;

(c) sweeping loose material from in front of the user through the space between the user's legs and into the bag;

(d) removing said spaced portions of the open mouth end of said bag from the user; and (e) drawing the mouth end of said bag to the closed position when said bag is filled with loose debris.

11. A method of collecting, transporting, and disposing loose debris comprising:

(a) providing a bag with a closed end and a mouth end having an open position and a closed position;

(b) securing spaced portions of the mouth end of said bag to the upper body and to the feet of a user such that the user stands in the open mouth end of said bag facing opposite said closed end with his legs spaced apart to permit access therebetween of loose debris when the mouth end ~~is in~~ the open position;

(c) sweeping loose material from in front of the user through the space between the user's legs and into the bag;

(d) drawing the mouth end of said bag into the closed position when said bag is filled with loose debris; and (e) moving said bag to a subsequent collection or disposal location by the carrying of said bag in the closed position.

* * * * *

UNITED STATES PATENT AND TRADEMARK OFFICE

CERTIFICATE OF CORRECTION

PATENT NO. : 5,020,184

DATED : June 4, 1991

INVENTOR(S) : John W. ROBERTS

It is certified that error appears in the above-identified patent and that said Letters Patent is hereby corrected as shown below:

Column 4, line 33, after "defining" add -- handles 36--.

Signed and Sealed this

Ninth Day of March, 1993

*Attest:*

STEPHEN G. KUNIN

*Attesting Officer*

*Acting Commissioner of Patents and Trademarks*